US005918310A

United States Patent [19]

Farahany

[11] Patent Number: 5,918,310

[45] Date of Patent: Jul. 6, 1999

[54] BODY PROTECTIVE GARMENT

[76] Inventor: Amir H. Farahany, 3452 Sharon Rd., Charlotte, N.C. 28211

[21] Appl. No.: 08/853,678

[22] Filed: May 9, 1997

[51] Int. Cl.[6] ..... A41D 13/00; A41D 1/06

[52] U.S. Cl. ..... 2/23; 2/455; 2/228

[58] Field of Search ..... 2/22, 24, 23, 455, 2/465, 228, 466, 456, 227; 602/23

[56] References Cited

U.S. PATENT DOCUMENTS

| | | | |
|---|---|---|---|
| 1,641,318 | 9/1927 | Carey | 2/22 |
| 2,087,045 | 7/1937 | Roberts et al. | 2/228 |
| 2,132,117 | 10/1938 | Korolick | 2/228 |
| 3,248,738 | 5/1966 | Morgan | 2/455 X |
| 4,486,901 | 12/1984 | Donzis | 2/22 X |
| 5,168,576 | 12/1992 | Krent et al. | 2/465 X |
| 5,315,716 | 5/1994 | Baum | 2/228 X |
| 5,584,072 | 12/1996 | Kim et al. | 2/22 X |
| 5,599,290 | 2/1997 | Hayes et al. | 2/465 X |
| 5,636,377 | 6/1997 | Wiener | 2/22 X |
| 5,658,246 | 8/1997 | Saca | 2/455 X |
| 5,675,844 | 10/1997 | Guyton et al. | 2/22 |

*Primary Examiner*—Michael A. Neas
*Attorney, Agent, or Firm*—Adams Law Firm, P.A.

[57] ABSTRACT

A body protective garment is adapted for covering a hip region of a wearer to protect the wearer against femoral fracture resulting from a sudden impact. The body protective garment includes an elastic girdle having a waist opening and a pair of leg openings. A plurality of pad-receiving pockets are attached to the girdle and adapted for overlying the hip region on opposing anterior sides and a rear thereof. A plurality of removable body protective pads are carried in the pockets. Each of the pads includes a multi-layer foam composite capable of reducing a 5800 N impact force to less than 1200 N.

1 Claim, 9 Drawing Sheets

BODY PROTECTIVE GARMENT

TECHNICAL FIELD AND BACKGROUND OF THE INVENTION

This invention relates to a body protective garment. The invention is particularly suited for persons over the age of 65 who are more likely a suffer a hip fracture or other serious injury resulting from a fall. Falls represent the leading injury-related cause of death for individuals in this age group. For example, the impact force on the hip when a 75 kg person falls in the muscle-relaxed state is about 5300 Newton (N). For elderly persons, as little as 1300 N can fracture the femur.

Several articles have been written discussing in detail the effect of impact forces on the hip, and the likelihood of suffering femoral fracture resulting from a fall. For persons over the age of 45, about 250,000 hip fractures occur annually in the United States alone. See articles entitled "Fracture Prediction for the Proximal Femur Using Finite Element Models" by Lotz, Cheal, and Hayes; and "Prediction of Femoral Impact Forces in Falls on the Hip" by Robinovitch and Hayes. The medical theories and predictions outlined in these articles are incorporated herein by reference.

Studies show that soft tissue thickness over the hip and muscle activity at impact are important determinants of fall fractures. While an increase in muscle rigidity during the descent phase of the fall may help adjust the body into a safe landing position, this increased muscle stiffness actually increases the impact force on the hip, thereby increasing the risk of femoral fracture. The lateral impact from a fall has the potential to fracture an elderly hip every time it happens.

The present invention helps protect the hip against fall fracture by providing body protective pads in areas of the hip region most susceptible to injury. The pads of this invention have been tested to effectively reduce a 5800 N impact force to less than 1200 N.

SUMMARY OF THE INVENTION

Therefore, it is an object of the invention to provide a body protective garment which protects the hip against injury from an impact force.

It is another object of the invention to provide a protective garment for use by the elderly to help prevent hip fracture resulting from a fall.

It is another object of the invention to provide a protective garment which includes body protective pads capable of reducing a 5800 N impact force to less than 1200 N.

It is another object of the invention to provide a protective garment which is easy to put on and take off.

It is another object of the invention to provide a protective garment which is launderable.

It is another object of the invention to provide a protective garment which is breathable to enhance moisture evaporation through the garment during wear.

It is another object of the invention to provide a protective garment which is relatively light weight.

It is another object of the invention to provide a protective garment for use by athletes in sports such as hockey, football, rugby, soccer, and the like.

It is another object of the invention to provide a body protective pad which is formed of a soft multi-layer foam material.

It is another object of the invention to provide a body protective pad which is relatively light weight.

It is another object of the invention to provide a body protective pad which is breathable for enhancing moisture evaporation.

These and other objects of the present invention are achieved in the preferred embodiments disclosed below by providing a body protective garment adapted for covering a hip region of a wearer to protect the wearer against femoral fracture resulting from a sudden impact. The body protective garment includes an elastic girdle having a waist opening and a pair of leg openings. A plurality of pad-receiving pockets are attached to the girdle and adapted for overlying the hip region on opposing anterior sides and a rear thereof. A plurality of removable body protective pads are carried in respective pockets. Each of the pads includes a multi-layer foam composite capable of reducing a 5800 N impact force to less than 1200 N.

According to one preferred embodiment of the invention, the foam composite includes an inside foam layer, a middle foam layer, and an outside foam layer.

According to another preferred embodiment of the invention, the inside and outside layers have a density of between 200–500 kg/m$^3$.

According to yet another preferred embodiment of the invention, the middle layer has a density of between 80–100 kg/m$^3$.

According to yet another preferred embodiment of the invention, the middle layer is at least twice as thick as either of the inside or outside layers.

According to yet another preferred embodiment of the invention, the inside and outside foam layers are perforated to reduce the overall weight of the pad and to promote moisture evaporation through the pad.

According to yet another preferred embodiment of the invention, each of the pads includes an outer fabric cover.

According to yet another preferred embodiment of the invention, and including at least one fastener extending longitudinally generally from the waist opening to one of the leg openings for fastening and unfastening the girdle from around the hip region of the wearer.

According to yet another preferred embodiment of the invention, first and second zippers are located in a front of the garment and extend longitudinally generally from the waist opening to respective leg openings for fastening and unfastening the girdle from around the hip region of the wearer.

According to yet another preferred embodiment of the invention, first and second protective flaps are provided for covering the ends of respective zippers when zipped.

A body protective pad according to one embodiment of the invention is used in a body protective garment. The garment is adapted for covering a hip region of a wearer to protect the wearer against femoral fracture resulting from a sudden impact. The body protective pad includes a multi-layer foam composite capable of reducing a 5800 N impact to less than 1200 N. The composite is formed of an inside foam layer having a density of between 200–500 kg/m$^3$, a middle foam layer having a density of between 80–100 kg/M$^3$, and an outside foam layer having a density of between 200–500 kg/m$^3$.

According to one preferred embodiment of the invention, the middle layer is at least twice as thick as either of the inside or outside layers.

According to another preferred embodiment of the invention, an outer fabric cover is provided for covering the pad.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
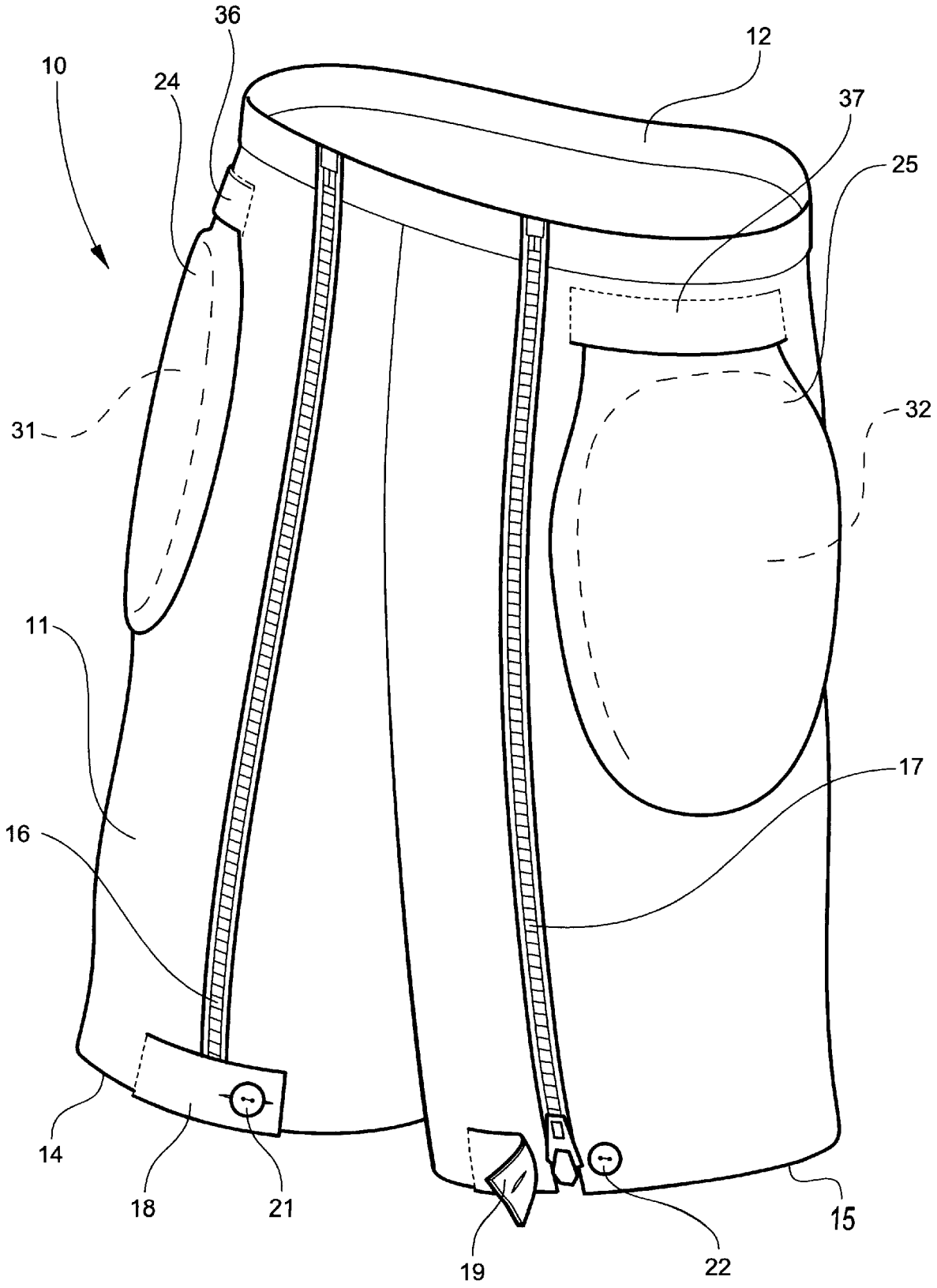
FIG. 1 is a perspective view of the body protection garment according to one preferred embodiment of the invention.
Figure 2:
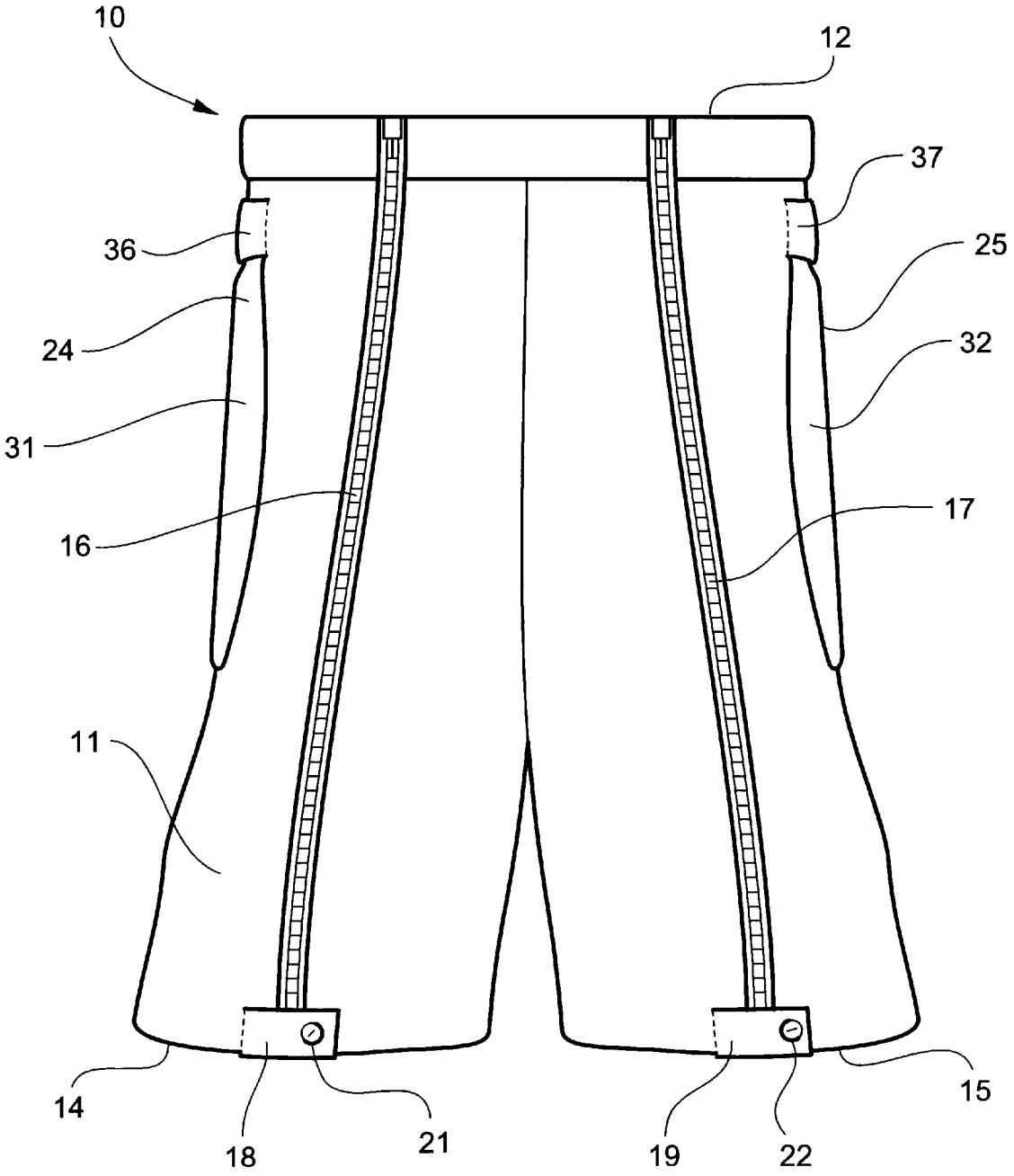
FIG. 2 is a front elevational view of the garment.
Figure 3:
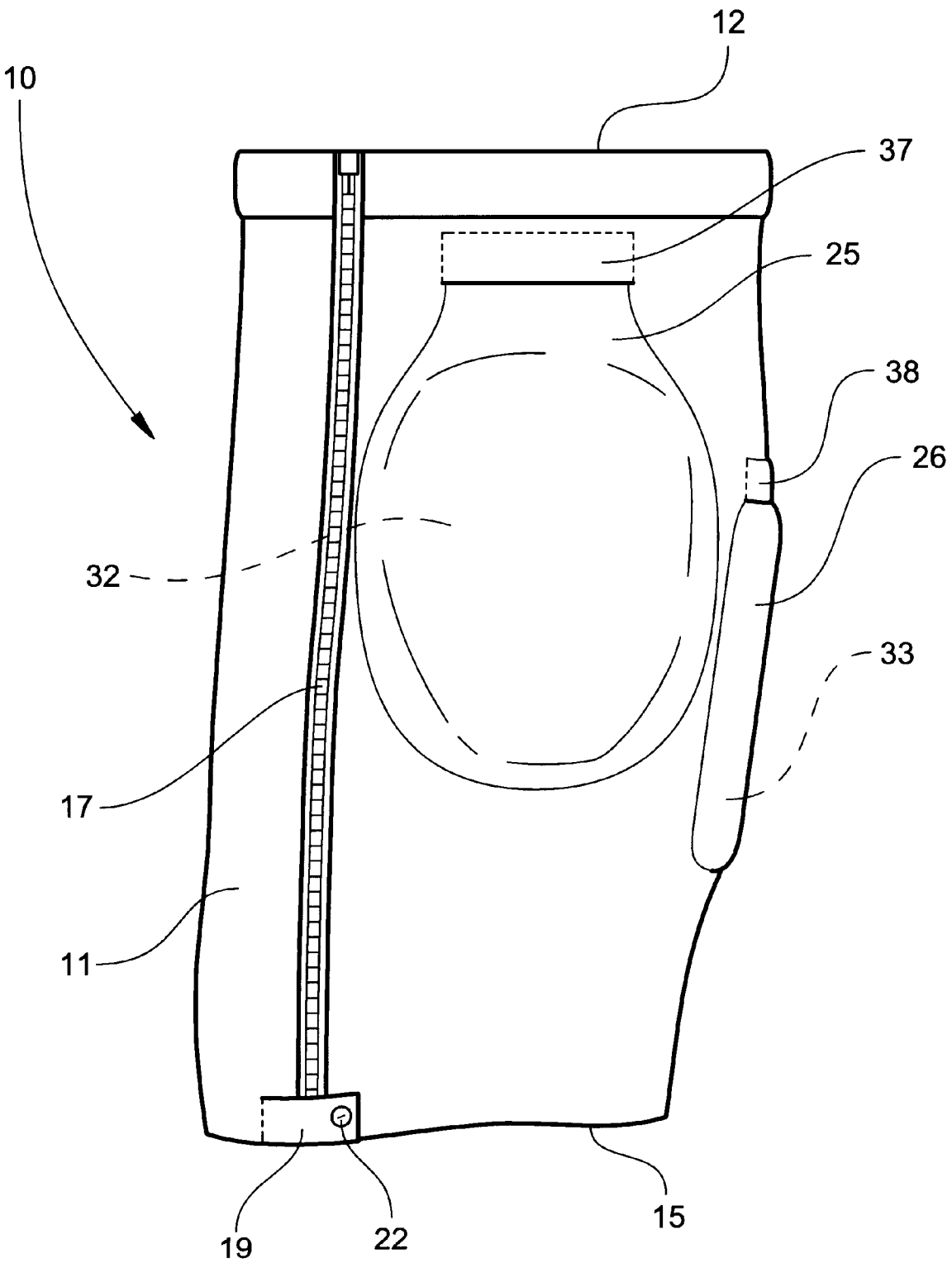
FIG. 3 is a side elevational view of the garment.
Figure 4:
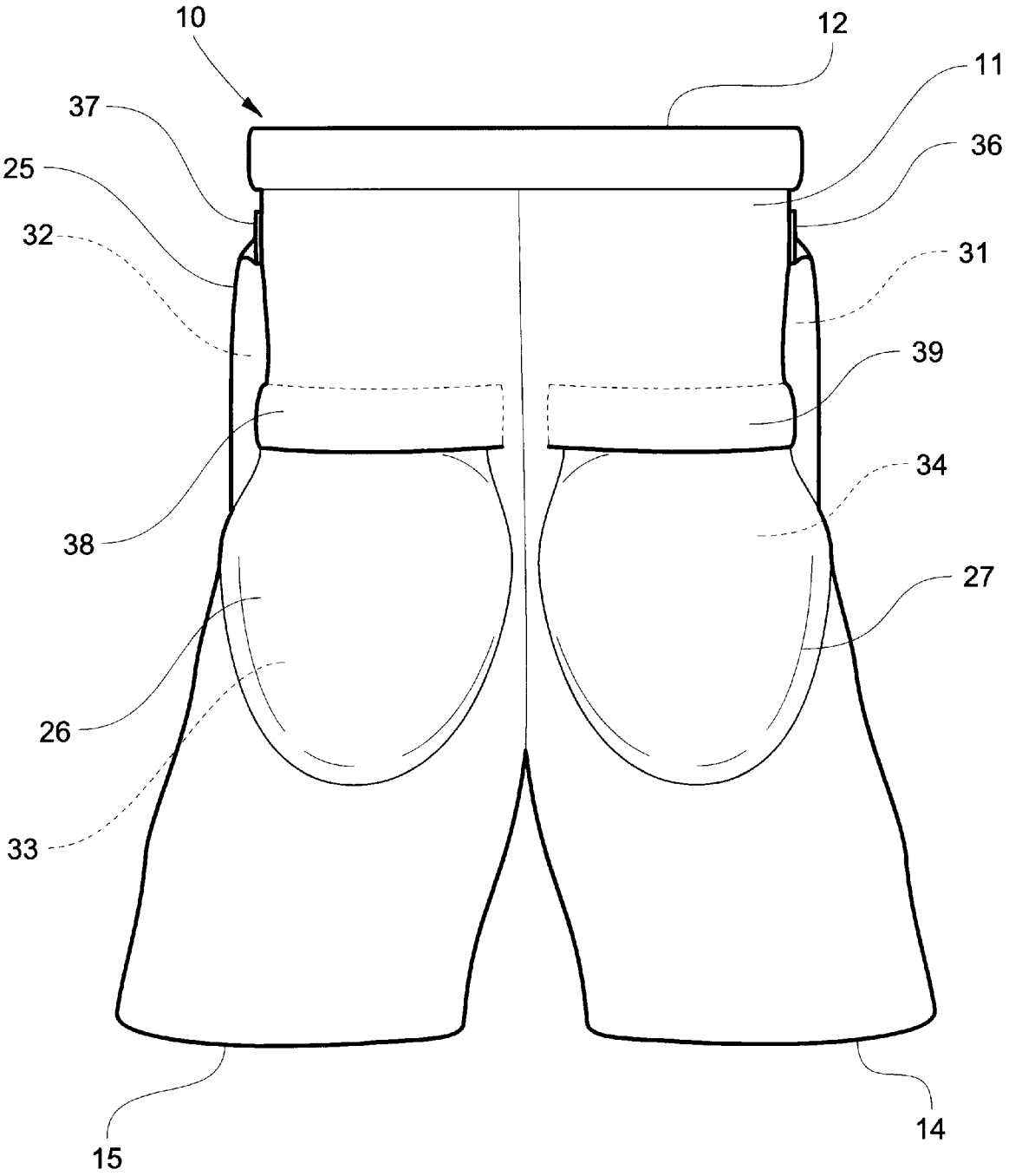
FIG. 4 is a rear elevational view of the garment.

Referring now specifically to the drawings, a body protective garment according to one embodiment of the present invention is illustrated in FIG. 1 and shown generally at reference numeral 10. The garment 10 disclosed is particularly adapted to protect the wearer against femoral fracture resulting from a fall.

As shown in FIGS. 1–4, the garment 10 includes an elastic girdle 11 which encircles the lower torso in the hip region of the wearer, and has a waist opening 12 and a pair of leg openings 14 and 15. Zippers 16 and 17 extend from the waist opening 12 to respective leg openings 14, 15 in the front of the girdle 11 for fastening and unfastening the girdle 11 from around the waist and thighs of the wearer. A pair of protective flaps 18 and 19 are attached adjacent the leg openings 14, 15 to cover the slide of the zippers 16, 17 when the girdle 11 is fully zipped. The flaps 18, 19 are fastened in place over the zipper slides by buttons 21 and 22. The girdle 11 is preferably formed of an elastic spandex material which is perforated to enhance its breathability.

Figure 5:
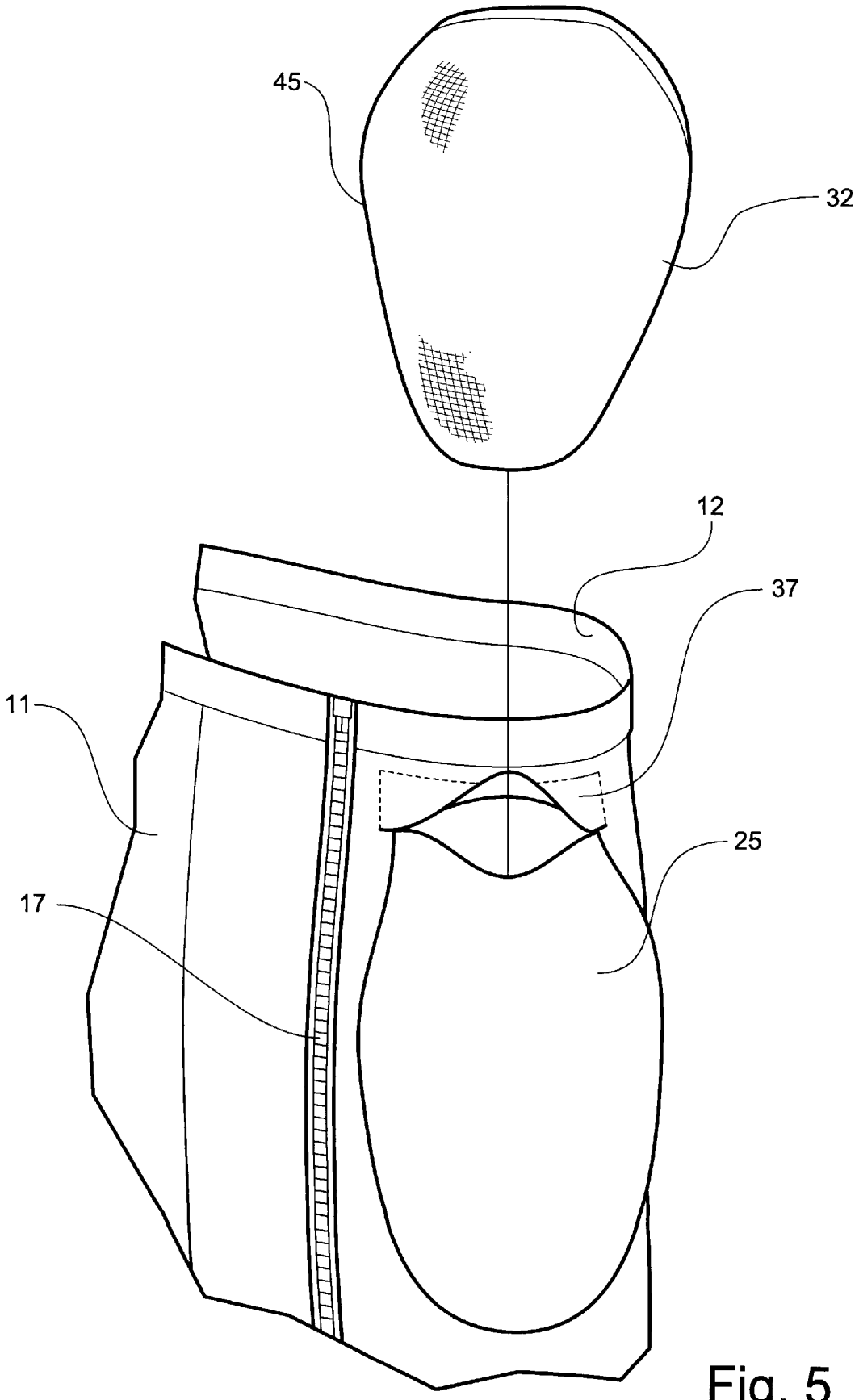
FIG. 5 is a fragmentary perspective view of the garment showing one of the pockets pulled partially open for receiving the removable body protective pad.

The girdle 11 includes a first set of pockets 24 and 25 arranged to overlie opposing anterior sides of the hip region, and a second set of pockets 26 and 27 for overlying the posterior of the hip region. The pockets 24, 25, 26, and 27 serve to receive and hold removable, body protective foam pads 31, 32, 33, and 34. The foam pads 31–34 collectively cover the areas of hip region most susceptible to injury from a fall. The pockets 24–27 further include separately attached elastic tops 36, 37, 38, and 39, respectively, which cover the opening of the pocket to further hold the pad inside the pocket when the garment is worn. FIG. 5 illustrates the pocket 25 pulled slightly open and the flap 37 pulled back to receive the pad 32. Preferably, the hip pads 31 and 32 are slightly larger than the rear pads 33 and 34.

Description of Pads 31–34

A single hip pad 31 and a rear pad 33 are shown in FIGS. 6–7 and 8–9, respectively. The corresponding hip and rear pads 32 and 34 not shown are of identical construction, and the following description of pads 31 and 33 is equally applicable to pads 32 and 34.

Figure 6:
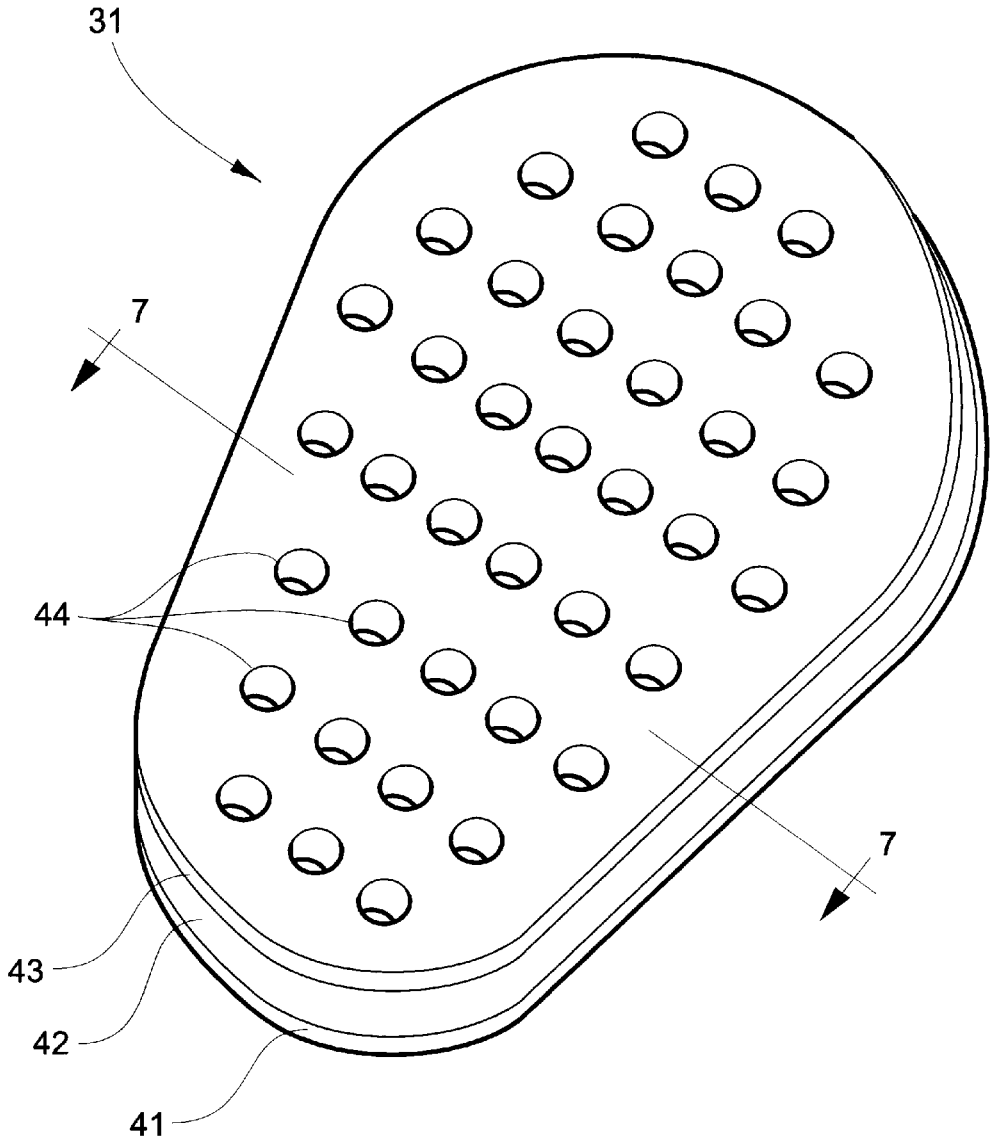
FIG. 6 is a perspective view of the body protective hip pad with the fabric cover removed.
Figure 7:
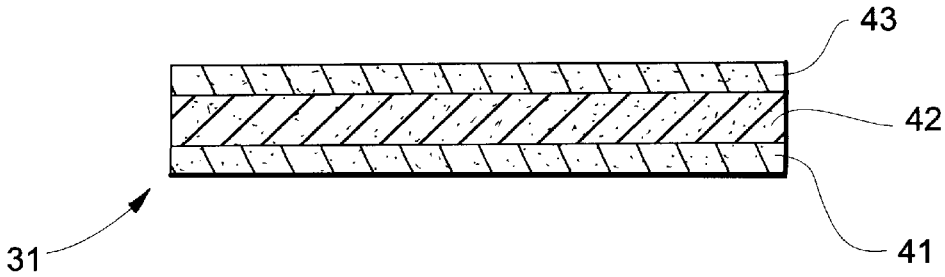
FIG. 7 is a cross-sectional view of the body protective hip pad taken substantially along line 7—7 of FIG. 6.

Referring to FIGS. 6 and 7, the hip pad 31 is a soft multi-layer polyurethane foam composite including an inside foam layer 41, a middle foam layer 42, and an outside foam layer 43 bonded together using a suitable adhesive. Preferably, the adhesive does not dissolve in warm water such that the garment 10 can be washed and dried with the pads in place without impairing the bond between layers 41, 42, and 43. The garment 10 is preferably washed in cold water. According to one embodiment, the inside and outside layers 41 and 43 have a foam density of between 200–500 kg/m$^3$. The middle foam layer 42 is about twice as thick as either of the layers 41 and 43, and has a lower density of between 80–100 kg/m$^3$.

Preferably, the pad 31 includes a number of perforations 44 extending entirely through the layers 41, 42, and 43 from one side of the pad 31 to the other. The perforations 44 reduce the overall weight of the pad 31 and promote moisture evaporation through the pad 31 without impairing its impact protection. The pad 31 may further include a fire-resistant fabric cover 45 shown in FIG. 5.

Figure 8:
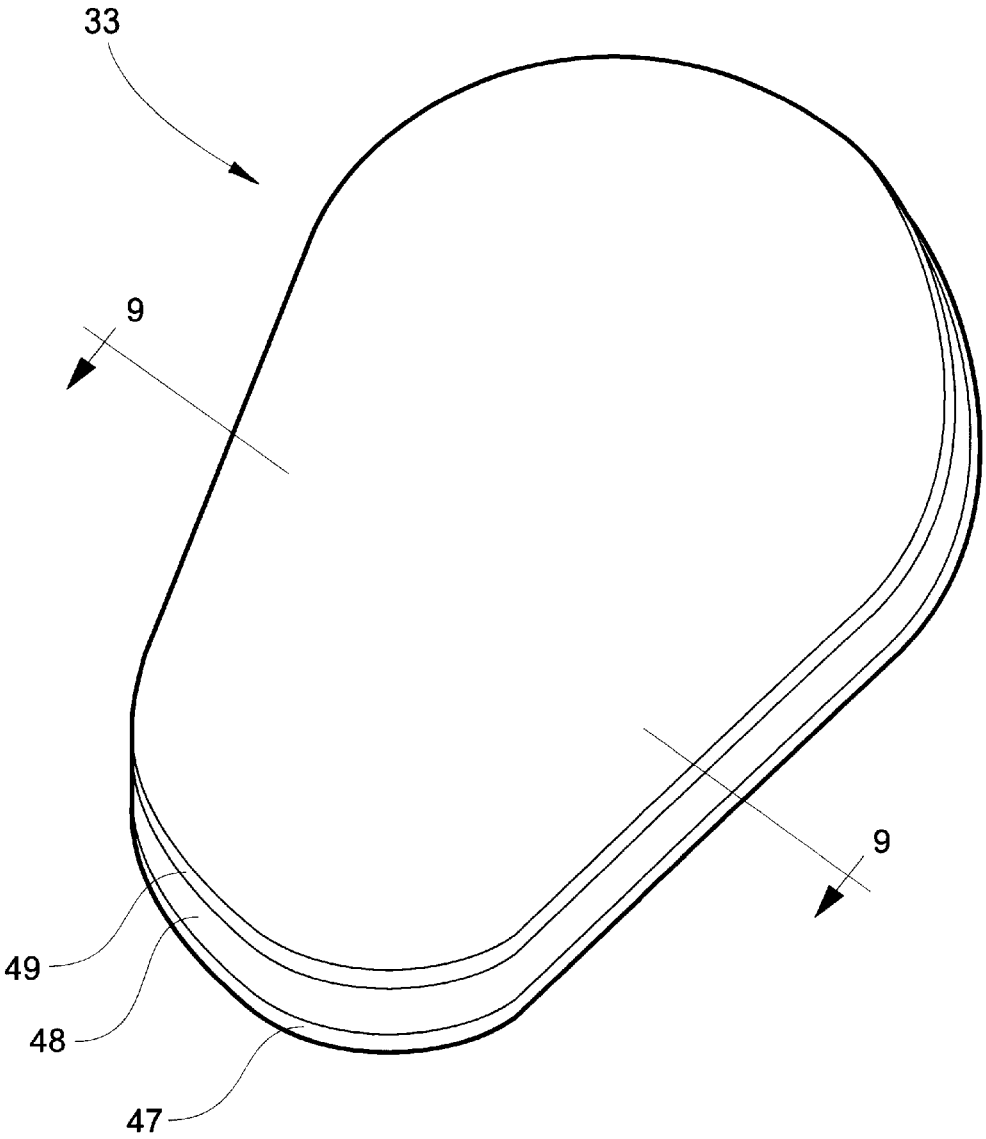
FIG. 8 is a perspective view of the body protective rear pad with the fabric cover removed.
Figure 9:
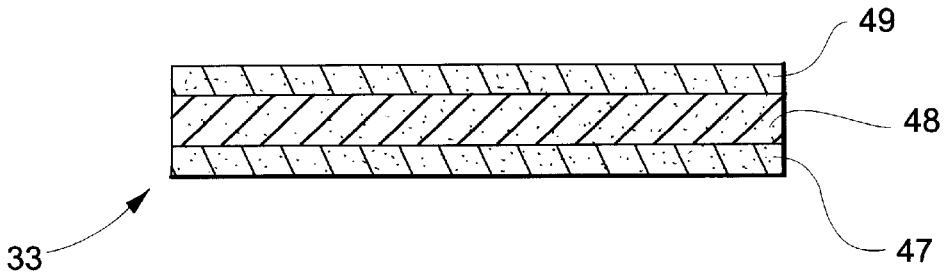
FIG. 9 is a cross-sectional view of the body protective rear pad taken substantially along line 9—9 of FIG. 8.

The rear pad 33 is shown in FIGS. 8 and 9. Like the hip pad 31, this pad 33 is a soft multi-layer polyurethane foam composite including an inside foam layer 47, a middle foam layer 48, and an outside foam layer 49. These layers 47, 48, and 49 are bonded together using an adhesive which preferably does not dissolve in warm water to allow washing and drying of the garment 10 with the pads in place. According to one embodiment, the inside and outside layers 47 and 49 have a foam density of between 200–500 kg/M$^3$. The middle foam layer 48 is about twice as thick as either of the layers 47 and 49, and has a lower density of between 80–100 kg/M$^3$. In addition, the pad 33 may further include a fire-resistant fabric cover (not shown). The rear pad 33 is smaller and lighter than the hip pad 31 and does not include perforations.

Figure 10:
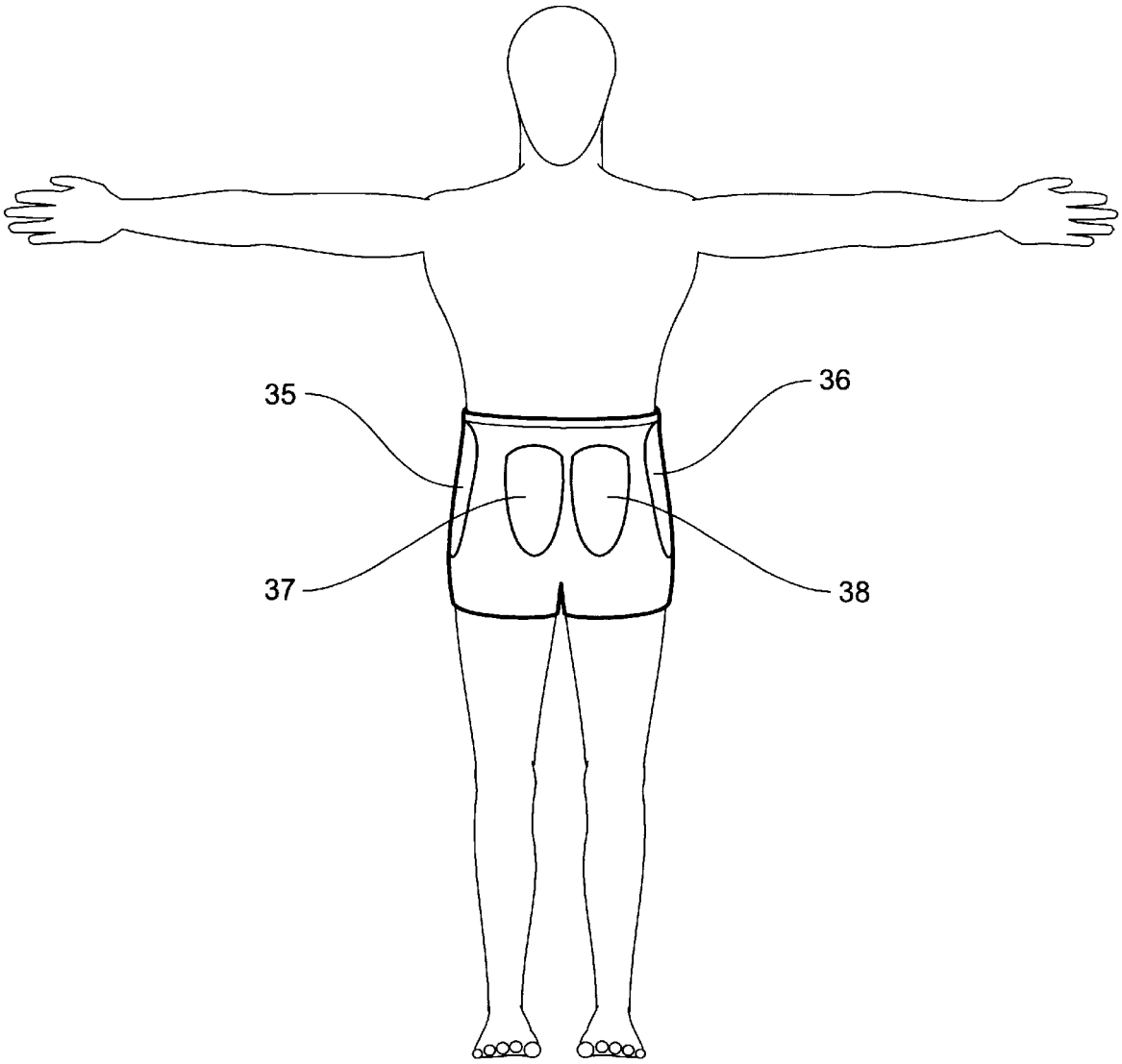
FIGS. 10 and 11 show the positioning of the garment around the lower torso of the body, and indicating the general areas of the hip region most protected against impact injury.
Figure 11:
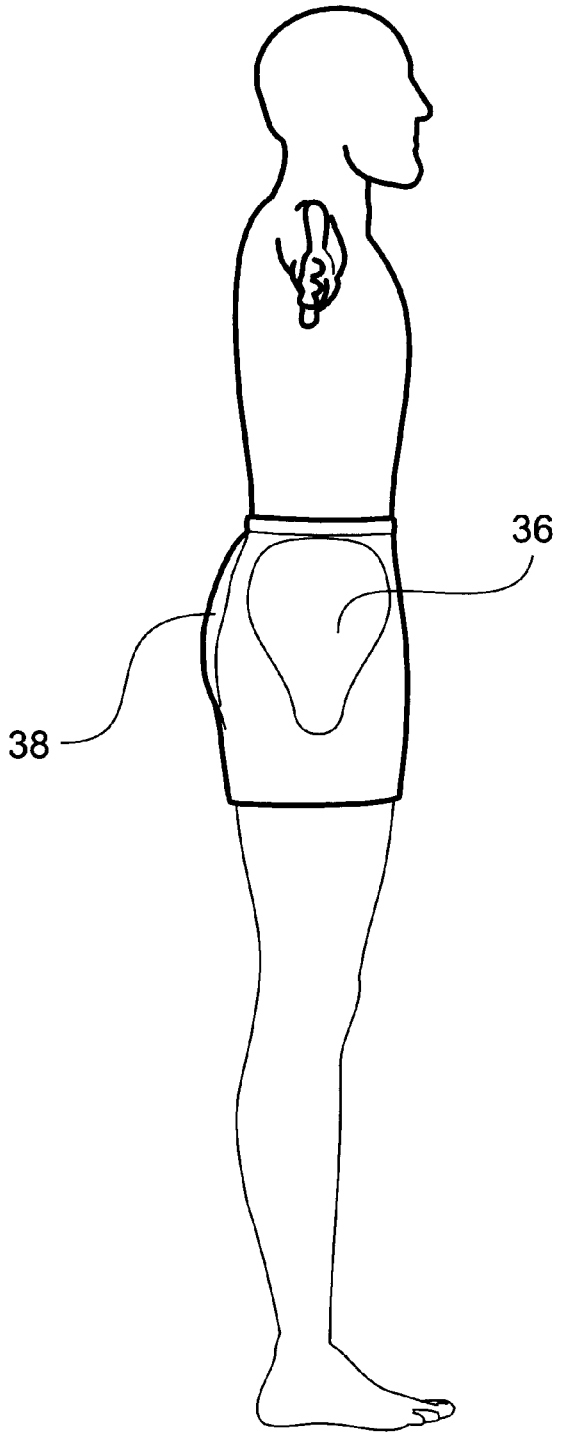

The inside and outside layers of each of the hip pads 31, 32 and rear pads 33, 34 are preferably made of a foam manufactured by the Rogers Corporation of East Woodstock, Conn., and sold under the trademark "Poron." The middle layers are preferably made of a foam manufactured by EAR Specialty Composites of Indianapolis, Ind., and sold under the trademark "Confor." Each one of the hip pads 31, 32 and rear pads 33, 34 is capable of reducing a 5800 N impact force to less than 1200 N, thereby substantially protecting the wearer against injury to the hip from a fall. The "hip region" is defined herein as that part of the body extending generally from the waist to the upper thigh, and including the lateral parts of the pelvis and upper part of the femur. The areas of the hip region most protected against direct impact injury when wearing the garment 10 are indicated generally by the shaded areas 35, 36, 37, and 37 in FIGS. 10 and 11.

In addition to the above, the protective pads of this invention can be used in other applications, such as in athletic wear including football pads, protective gear for baseball catchers, and other protective accessories, such as knee and elbow pads. The pads may also be used in bicycle and motorcycle helmets.

A body protective garment is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A body protective garment adapted for covering a hip region of a wearer to protect the wearer against femoral fracture resulting from a sudden impact, said body protective garment comprising:

(a) an elastic girdle including a waist opening and a pair of leg openings, first and second zippers located in a front of said girdle and extending longitudinally generally from the waist opening to respective leg openings for fastening and unfastening said girdle from around the hip region of the wearer, and first and second protective flaps for covering the ends of respective zippers when zipped;

(b) a plurality of pad-receiving pockets attached to the girdle and adapted for overlying the bip region on opposing anterior sides and a rear thereof;

(c) a plurality of removable body protective pads carried in respective pockets, each of said pads comprising a multi-layer foam composite capable of reducing a 5800 N impact force to less than 1200 N, said foam composite comprising:

(i) inside and outside foam layers each having a density of between 200–500 kg/m$^3$;

(ii) a middle foam layer located between the inside and outside foam layers and having a density of between 80–100 kg/m$^3$, the middle layer being at least twice as thick as either of the inside or outside layers;

(iii) said foam composite defining a plurality of perforations extending through said layers from one side of the pad to the other to reduce the overall weight of the pad and to promote moisture evaporation through the pad; and (d) a fire-resistant outer fabric cover surrounding the layers of each of said body protective pads.

* * * * *